US009187959B2

(12) United States Patent
Treviranus et al.

(10) Patent No.: US 9,187,959 B2
(45) Date of Patent: Nov. 17, 2015

(54) AUTOMATED STEERABLE HOLE ENLARGEMENT DRILLING DEVICE AND METHODS

(75) Inventors: Joachim Treviranus, Winsen/Aller (DE); Carsten Freyer, Lower Saxony (DE); Hans-Robert Oppelaar, Lower Sachsony (DE)

(73) Assignee: Baker Hughes Incorporated, Hosuton, TX (US)

( * ) Notice: Subject to any disclaimer, the term of this patent is extended or adjusted under 35 U.S.C. 154(b) by 0 days.

(21) Appl. No.: 11/681,370

(22) Filed: Mar. 2, 2007

(65) Prior Publication Data

US 2007/0205022 A1 Sep. 6, 2007

Related U.S. Application Data

(60) Provisional application No. 60/778,329, filed on Mar. 2, 2006.

(51) Int. Cl.

| | |
|---|---|
| ***E21B 10/32*** | (2006.01) |
| ***E21B 7/06*** | (2006.01) |
| ***E21B 47/12*** | (2012.01) |

(52) U.S. Cl.

CPC ..... *E21B 10/322* (2013.01); *E21B 7/06* (2013.01); *E21B 47/12* (2013.01)

(58) Field of Classification Search

CPC ... E21B 10/322; E21B 17/1014; E21B 7/068; E21B 44/005; E21B 10/26; E21B 10/32; E21B 10/325; E21B 10/345; E21B 10/62; E21B 4/00; E21B 7/04

USPC ..... 175/26, 45, 61, 267, 263, 269, 385

See application file for complete search history.

(56) References Cited

U.S. PATENT DOCUMENTS 1,406,348 A * 2/1922 Corrigan ..... 175/97
1,678,075 A 7/1928 Phipps (Continued)

FOREIGN PATENT DOCUMENTS

EP 246789 A2 11/1987
EP 1036913 A1 9/2000

(Continued)

OTHER PUBLICATIONS

International Search Report for International Application No. PCT/US2007/005486 dated Aug. 28, 2007, 5 pages.

(Continued)

*Primary Examiner* — Shane Bomar
*Assistant Examiner* — Kipp Wallace
(74) *Attorney, Agent, or Firm* — TraskBritt

(57) ABSTRACT

A bottom hole assembly (BHA) coupled to a drill string includes a steering device, one or more controllers, and a hole enlargement device that selectively enlarges the diameter of the wellbore formed by the drill bit. In an automated drilling mode, the controller controls drilling direction by issuing instructions to the steering device. In one arrangement, the hole enlargement device is integrated into a shaft of a drilling motor that rotates the drill bit. The hole enlargement device includes an actuation unit and an electronics package that cooperate to translate extendable cutting elements between a radially extended position and a radially retracted position. The electronics package may be responsive to a signal that is transmitted from a downhole and/or a surface location. The hole enlargement device may also include one or more position sensors that transmit a position signal indicative of a radial position of the cutting elements.

21 Claims, 3 Drawing Sheets

(56) References Cited

U.S. PATENT DOCUMENTS

| | | | | | |
|---|---|---|---|---|---|
| 2,069,482 | A | | 2/1937 | Seay | |
| 2,177,721 | A | | 10/1939 | Johnson et al. | |
| 2,344,598 | A | | 3/1944 | Church | |
| 2,754,089 | A | | 7/1956 | Kammerer, Jr. | |
| 2,758,819 | A | | 8/1956 | Kammerer, Jr. | |
| 2,834,578 | A | | 5/1958 | Carr | |
| 2,882,019 | A | | 4/1959 | Carr et al. | |
| 3,105,562 | A | | 10/1963 | Stone et al. | |
| 3,123,162 | A | | 3/1964 | Rowley | |
| 3,126,065 | A | | 3/1964 | Chadderdon | |
| 3,211,232 | A | | 10/1965 | Grimmer | |
| 3,224,507 | A | | 12/1965 | Cordary, Jr. et al. | |
| 3,425,500 | A | | 2/1969 | Fuchs | |
| 3,433,313 | A | | 3/1969 | Brown | |
| 3,556,233 | A | | 1/1971 | Gilreath | |
| 4,403,659 | A | | 9/1983 | Upchurch | |
| 4,403,664 | A | | 9/1983 | Sullinger | |
| 4,413,682 | A | | 11/1983 | Callihan et al. | |
| 4,458,761 | A | | 7/1984 | Van Vreeswyk | |
| 4,545,441 | A | | 10/1985 | Williamson | |
| 4,548,282 | A | * | 10/1985 | Hurtz et al. | 175/61 |
| 4,589,504 | A | | 5/1986 | Simpson | |
| 4,660,657 | A | | 4/1987 | Furse et al. | |
| 4,690,229 | A | | 9/1987 | Raney | |
| 4,693,328 | A | | 9/1987 | Furse et al. | |
| 4,842,083 | A | | 6/1989 | Raney | |
| 4,848,490 | A | | 7/1989 | Anderson | |
| 4,854,403 | A | | 8/1989 | Ostertag et al. | |
| 4,862,974 | A | * | 9/1989 | Warren et al. | 175/61 |
| 4,884,477 | A | | 12/1989 | Smith et al. | |
| 4,889,197 | A | | 12/1989 | Boe | |
| 5,060,736 | A | * | 10/1991 | Neff | 175/74 |
| 5,103,919 | A | * | 4/1992 | Warren et al. | 175/45 |
| 5,139,098 | A | | 8/1992 | Blake | |
| 5,211,241 | A | | 5/1993 | Mashaw et al. | |
| 5,220,963 | A | | 6/1993 | Patton | |
| 5,224,558 | A | | 7/1993 | Lee | |
| 5,265,684 | A | | 11/1993 | Rosenhauch | |
| 5,293,945 | A | | 3/1994 | Rosenhauch et al. | |
| 5,305,833 | A | | 4/1994 | Collins | |
| 5,307,886 | A | | 5/1994 | Hopper | |
| 5,318,131 | A | | 6/1994 | Baker | |
| 5,318,137 | A | | 6/1994 | Johnson et al. | |
| 5,318,138 | A | | 6/1994 | Dewey et al. | |
| 5,332,048 | A | | 7/1994 | Underwood et al. | |
| 5,343,963 | A | | 9/1994 | Bouldin et al. | |
| 5,361,859 | A | | 11/1994 | Tibbitts | |
| 5,368,114 | A | | 11/1994 | Tandberg et al. | |
| 5,375,662 | A | | 12/1994 | Echols, III et al. | |
| 5,394,951 | A | | 3/1995 | Pringle | |
| 5,425,423 | A | | 6/1995 | Dobson et al. | |
| 5,437,308 | A | | 8/1995 | Morin et al. | |
| 5,553,678 | A | | 9/1996 | Barr et al. | |
| 5,560,440 | A | | 10/1996 | Tibbitts et al. | |
| 5,603,386 | A | * | 2/1997 | Webster | 175/76 |
| 5,740,864 | A | | 4/1998 | de Hoedt et al. | |
| 5,787,999 | A | | 8/1998 | Holte | |
| 5,788,000 | A | | 8/1998 | Maury et al. | |
| 5,823,254 | A | | 10/1998 | Dobson et al. | |
| 5,887,655 | A | | 3/1999 | Haugen et al. | |
| 5,899,268 | A | | 5/1999 | Lynde et al. | |
| 6,000,479 | A | | 12/1999 | Ambs | |
| 6,039,131 | A | | 3/2000 | Beaton | |
| 6,059,051 | A | * | 5/2000 | Jewkes et al. | 175/76 |
| 6,070,677 | A | | 6/2000 | Johnston | |
| 6,109,354 | A | | 8/2000 | Ringgenberg et al. | |
| 6,109,372 | A | * | 8/2000 | Dorel et al. | 175/61 |
| 6,116,336 | A | | 9/2000 | Adkins et al. | |
| 6,131,675 | A | | 10/2000 | Anderson | |
| 6,189,631 | B1 | | 2/2001 | Sheshtawy | |
| 6,196,336 | B1 | * | 3/2001 | Fincher et al. | 175/101 |
| 6,213,226 | B1 | | 4/2001 | Eppink et al. | |
| 6,227,312 | B1 | | 5/2001 | Eppink et al. | |
| 6,289,999 | B1 | | 9/2001 | Dewey et al. | |
| 6,325,151 | B1 | | 12/2001 | Vincent et al. | |
| 6,378,632 | B1 | | 4/2002 | Dewey | |
| 6,419,033 | B1 | | 7/2002 | Hahn et al. | |
| 6,427,783 | B2 | | 8/2002 | Krueger et al. | |
| 6,488,104 | B1 | * | 12/2002 | Eppink et al. | 175/61 |
| 6,494,272 | B1 | | 12/2002 | Eppink et al. | |
| 6,513,606 | B1 | | 2/2003 | Krueger | |
| 6,609,579 | B2 | * | 8/2003 | Krueger et al. | 175/325.3 |
| 6,615,933 | B1 | | 9/2003 | Eddison | |
| 6,629,570 | B1 | | 10/2003 | Head | |
| 6,668,936 | B2 | | 12/2003 | Williamson, Jr. et al. | |
| 6,668,949 | B1 | * | 12/2003 | Rives | 175/269 |
| 6,679,328 | B2 | | 1/2004 | Davis et al. | |
| 6,705,413 | B1 | * | 3/2004 | Tessari | 175/22 |
| 6,708,785 | B1 | | 3/2004 | Russell et al. | |
| 6,732,817 | B2 | | 5/2004 | Dewey et al. | |
| 6,848,518 | B2 | | 2/2005 | Chen et al. | |
| 6,920,944 | B2 | * | 7/2005 | Eppink et al. | 175/53 |
| 7,048,078 | B2 | | 5/2006 | Dewey et al. | |
| 7,096,978 | B2 | | 8/2006 | Dykstra et al. | |
| 7,287,604 | B2 | * | 10/2007 | Aronstam et al. | 175/61 |
| 7,303,022 | B2 | * | 12/2007 | Tilton et al. | 166/380 |
| 7,306,056 | B2 | * | 12/2007 | Ballantyne et al. | 175/61 |
| 7,314,099 | B2 | | 1/2008 | Dewey et al. | |
| 7,395,882 | B2 | | 7/2008 | Oldham et al. | |
| 7,481,280 | B2 | * | 1/2009 | Benge et al. | 175/57 |
| 7,513,318 | B2 | | 4/2009 | Underwood et al. | |
| 7,708,086 | B2 | | 5/2010 | Witte | |
| 7,757,784 | B2 | * | 7/2010 | Fincher et al. | 175/57 |
| 2001/0042643 | A1 | | 11/2001 | Krueger et al. | |
| 2002/0070052 | A1 | | 6/2002 | Armell | |
| 2003/0029644 | A1 | | 2/2003 | Hoffmaster et al. | |
| 2003/0051881 | A1 | | 3/2003 | Vinegar et al. | |
| 2003/0070842 | A1 | * | 4/2003 | Bailey et al. | 175/24 |
| 2003/0079913 | A1 | * | 5/2003 | Eppink et al. | 175/61 |
| 2004/0050589 | A1 | | 3/2004 | Head | |
| 2004/0134687 | A1 | * | 7/2004 | Radford et al. | 175/57 |
| 2004/0149431 | A1 | * | 8/2004 | Wylie et al. | 166/242.1 |
| 2005/0056463 | A1 | * | 3/2005 | Aronstam et al. | 175/61 |
| 2005/0126826 | A1 | | 6/2005 | Moriarty et al. | |
| 2005/0139393 | A1 | | 6/2005 | Maurer | |
| 2005/0197777 | A1 | * | 9/2005 | Rodney et al. | 702/9 |
| 2005/0211470 | A1 | | 9/2005 | Jeffryes | |
| 2006/0124354 | A1 | * | 6/2006 | Witte | 175/40 |
| 2006/0237234 | A1 | * | 10/2006 | Dennis et al. | 175/95 |
| 2007/0205022 | A1 | | 9/2007 | Treviranus et al. | |
| 2009/0242275 | A1 | | 10/2009 | Radford et al. | |
| 2009/0294178 | A1 | | 12/2009 | Radford | |
| 2010/0139981 | A1 | | 6/2010 | Meister et al. | |
| 2010/0282511 | A1 | | 11/2010 | Maranuk et al. | |
| 2011/0284233 | A1 | | 11/2011 | Wu et al. | |

FOREIGN PATENT DOCUMENTS

| | | | | | |
|---|---|---|---|---|---|
| EP | 1044314 | A1 | | 3/2005 | |
| GB | 2319046 | | | 5/1998 | |
| GB | 2328964 | A | | 3/1999 | |
| GB | 2344607 | | | 6/2000 | |
| GB | 2357101 | | | 6/2001 | |
| GB | 2344122 | B | | 4/2003 | |
| GB | 2401384 | | | 11/2004 | |
| WO | 0031371 | A1 | | 6/2000 | |
| WO | WO 2004097163 | A1 | * | 11/2004 | E21B 10/32 |
| WO | WO 2006/112763 | A1 | | 10/2006 | |

OTHER PUBLICATIONS

International Written Opinion for International Application No. PCT/US2007/005486 dated Aug. 28, 2007, 5 pages.

International Preliminary Report on Patentability for International Application No. PCT/US2007/005486 dated Sep. 2, 2008, 6 pages.

Rasheed, Wajid et al., SPE 92623,"Reducing Risk and Cost in Diverse Well Construction Applications: Eccentric Deice Drills Concentric Hole and Offers a Viable Alternative to Underreamers", 2004.

* cited by examiner

AUTOMATED STEERABLE HOLE ENLARGEMENT DRILLING DEVICE AND METHODS

CROSS-REFERENCE TO RELATED APPLICATION

This application claims the benefit of U.S. Provisional Application Ser. No. 60/778,329 filed Mar. 2, 2006.

TECHNICAL FIELD

This disclosure relates generally to oilfield downhole tools and, more particularly, to modular drilling assemblies utilized for drilling wellbores having one or more enlarged diameter sections.

BACKGROUND

To obtain hydrocarbons such as oil and gas, boreholes or wellbores are drilled by rotating a drill bit attached to the bottom of a drilling assembly (also referred to herein as a "Bottom Hole Assembly" or "BHA.") The drilling assembly is attached to the bottom of a tubing or tubular string, which is usually either a jointed rigid pipe (or "drill pipe") or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore via an annulus between the drill string and the wellbore wall. The mud motor is rotated by the drilling fluid passing through the drilling assembly. A drive shaft connected to the motor and the drill bit rotates the drill bit.

In certain instances, it may be desired to form a wellbore having a diameter larger than that formed by the drill bit. For instance, in some applications, constraints on wellbore geometry during drilling may result in a relatively small annular space in which cement may flow, reside and harden. In such instances, the annular space may need to be increased to accept an amount of cement necessary to suitably fix a casing or liner in the wellbore. In other instances, an unstable formation such as shale may swell to reduce the diameter of the drilled wellbore. To compensate for this swelling, the wellbore may have to be drilled to a larger diameter while drilling through the unstable formation. Furthermore, it may be desired to increase the diameter of only certain sections of a wellbore in real-time and in a single trip.

The present disclosure addresses the need for systems, devices and methods for selectively increasing the diameter of a drilled wellbore.

DISCLOSURE

The present disclosure relates to devices and methods for drilling wellbores with one or more pre-selected bore diameters. An exemplary BHA made in accordance with the present disclosure may be deployed via a conveyance device such as a tubular string, which may be jointed drill pipe or coiled tubing, into a wellbore. The BHA may include a hole enlargement device, devices for automatically steering the BHA, and tools for measuring selected parameters of interest. In one embodiment, a downhole and/or surface controller controls a steering device adapted to steer a drill bit in a selected direction. Bidirectional data communication between the BHA and the surface may be provided by a data conductor, such as a wire, formed along a drilling tubular such as jointed pipe or coiled tubing. The conductor may be embedded in a wall of the drilling tubular or run inside or outside of the drilling tubular. The hole enlargement device, which is positioned adjacent the drill bit, includes one or more extendable cutting elements that selectively enlarges the diameter of the wellbore formed by the drill bit. In an automated or closed-loop drilling mode, the controller is programmed with instructions for controlling the steering device in response to a measured parameter of interest. Illustrative parameters include directional parameters such as BHA coordinates, formation parameters (e.g., resistivity, dielectric constant, water saturation, porosity, density and permeability), and BHA and drill string parameters (stress, strain, pressure, etc.).

In one arrangement, the BHA includes a drilling motor that rotates the drill bit. The hole enlargement device is integrated into a shaft of the drilling motor. In other arrangements, the hole enlargement device may be integrated into the body of the drill bit or positioned in a separate section of the BHA. An exemplary hole enlargement device includes an actuation unit that translates or moves the extendable cutting elements between a radially extended position and a radially retracted position. The actuation unit includes a piston-cylinder type arrangement that is energized using pressurized hydraulic fluid. Valves and valve actuators control the flow of fluid between a fluid reservoir and the piston-cylinder assemblies. An electronics package positioned in the hole enlargement device operate the valves and valve actuators in response to a signal that is transmitted from a downhole and/or a surface location. In some embodiments, the actuation unit is energized using hydraulic fluid in a closed loop. In other embodiments, pressurized drilling fluid may be used. In still other embodiments, mechanical or electromechanical actuation units may be employed. The hole enlargement device may also include one or more position sensors that transmit a position signal indicative of a radial position of the cutting elements. In addition to the tools and equipment described above, a suitable BHA may also include a "bidirectional data communication and power" ("BCPM") unit, sensor and formation evaluation subs, and stabilizers. Bidirectional communication between the hole enlargement device and the surface or other locations may be established using conductors positioned along a drilling tubular, such as drill pipe or coiled tubing. For example, the drilling tubular may include data and/or power conductors embedded in a wall or run inside or outside of the drilling tubular.

In one operating mode, the drill string, together with the BHA described above, is conveyed into the wellbore. Drilling fluid pumped from the surface via the drill string energizes the drilling motor, which then rotates the drill bit to drill the wellbore. The drill string itself may be maintained substantially rotationally stationary to prevent damage to the interior surfaces of the drilled wellbore and any casing or liners. During this "sliding" drilling mode, the steering device steers the drill bit in a selected direction. The direction of drilling may be controlled by one or more controllers such that drilling proceeds in an automated or closed-loop fashion. Based on measured parameters, the controller(s) issue(s) instructions to the steering device such that a selected wellbore trajectory is followed.

As needed, the hole enlargement device positioned adjacent the drill bit is activated to enlarge the diameter of the wellbore formed by the drill bit. For instance, surface personnel may transmit a signal to the electronics package for the hole enlargement device that causes the actuation unit to translate the cutting elements from a radially retracted position to a radially extended position. The position sensors upon detecting the extended position transmit a position signal indicative of an extended position to the surface. Thus, surface personnel have a positive indication of the position of the cutting elements. Advantageously, surface personnel may activate the hole enlargement device in real-time while drilling and/or during interruptions in drilling activity. For instance, prior to drilling into an unstable formation, the cutting elements may be extended to enlarge the drilled wellbore diameter. After traversing the unstable formation, surface personnel may retract the cutting elements. In other situations, the cutting elements may be extended to enlarge the annular space available for cementing a casing or liner in place.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
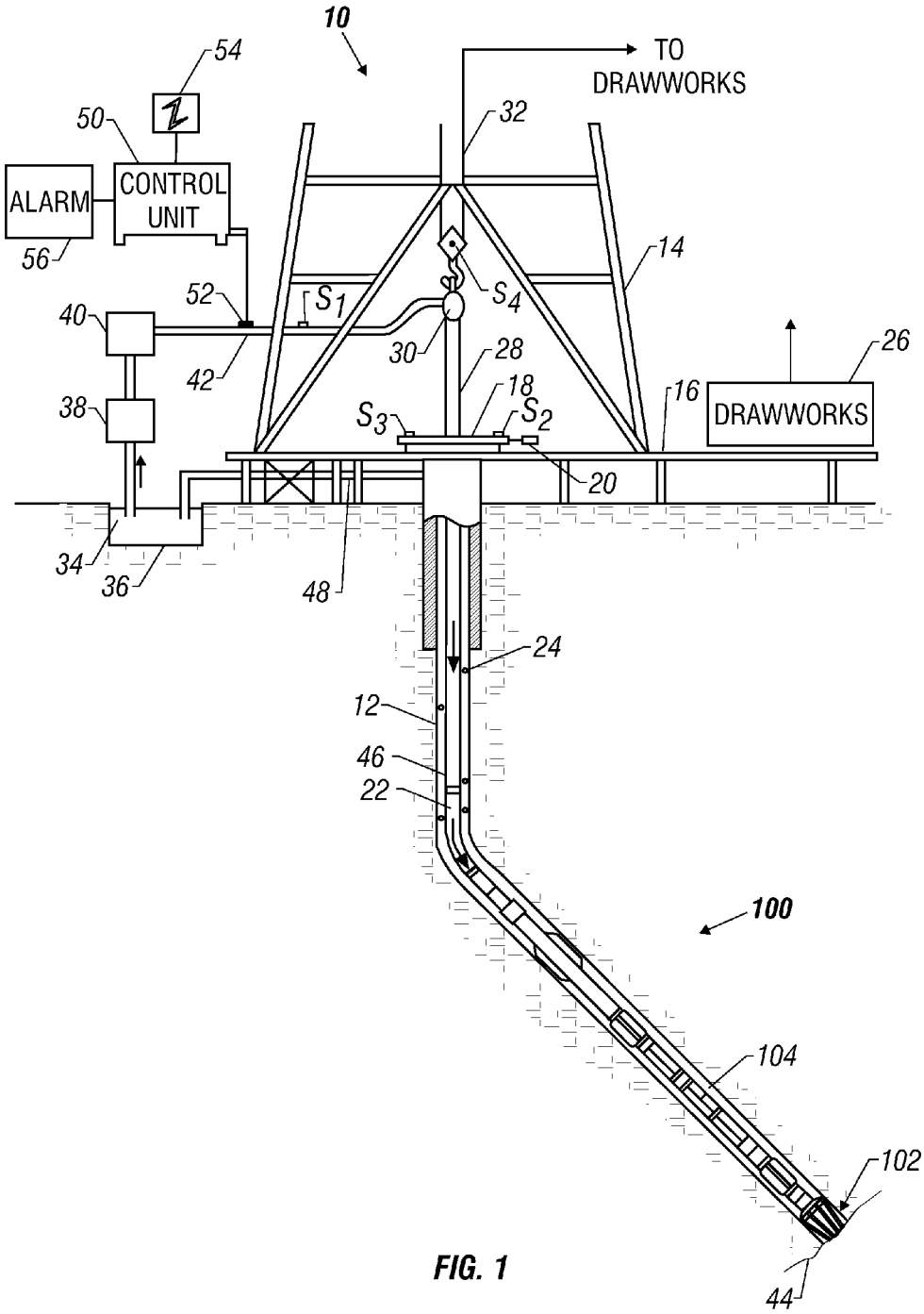
FIG. 1 illustrates a drilling system made in accordance with one embodiment of the present disclosure.

The present disclosure relates to devices and methods for drilling wellbores with one or more pre-selected bore diameters. The teachings of the present disclosure may be advantageously applied to "sliding" drilling operations that are performed by an automated drilling assembly. It will be understood, however, that the present disclosure may be applied to numerous other drilling strategies and systems. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown an embodiment of a drilling system 10 utilizing a drilling assembly or bottom hole assembly (BHA) 100 made according to one embodiment of the present disclosure to drill wellbores. While a land-based rig is shown, these concepts and the methods are equally applicable to offshore drilling systems. The system 10 shown in FIG. 1 has a drilling assembly 100 conveyed in a borehole 12. A drill string 22 includes a jointed tubular string 24, which may be drill pipe or coiled tubing, extending downward from a rig 14 into the borehole 12. A drill bit 102, attached to the end of the drill string 22, disintegrates the geological formations when it is rotated to drill the borehole 12. The drill string 22, which may be jointed tubulars or coiled tubing, may include power and/or data conductors such as wires for providing bidirectional communication and power transmission. The drill string 22 is coupled to a drawworks 26 via a kelly joint 28, swivel 30 and line 32 through a pulley (not shown). The operation of the drawworks 26 is well known in the art and is thus not described in detail herein.

During drilling operations, a suitable drilling fluid 34 from a mud pit (source) 36 is circulated under pressure through the drill string 22 by a mud pump 38. The drilling fluid 34 passes from the mud pump 38 into the drill string 22 via a desurger 40, fluid line 42 and the kelly joint 28. The drilling fluid 34 is discharged at a borehole bottom 44 through an opening in the drill bit 102. The drilling fluid 34 circulates uphole through an annular space 46 between the drill string 22 and the borehole 12 and returns carrying drill cuttings to the mud pit 36 via a return line 48. A sensor $S_1$, preferably placed in the line 42, provides information about the fluid flow rate. A surface torque sensor $S_2$ and a sensor $S_3$ associated with the drill string 22, respectively, provide information about the torque and the rotational speed of the drill string 22. Additionally, a sensor $S_4$ associated with line 32 is used to provide the hook load of the drill string 22.

A surface controller 50 receives signals from the downhole sensors and devices via a sensor 52 placed in the fluid line 42 and signals from sensors $S_1$, $S_2$, $S_3$, hook load sensor $S_4$, and any other sensors used in the system, and processes such signals according to programmed instructions provided to the surface controller 50. The surface controller 50 displays desired drilling parameters and other information on a display/monitor 54 and is utilized by an operator to control the drilling operations. The surface controller 50 contains a computer, memory for storing data, recorder for recording data and other peripherals. The surface controller 50 processes data according to programmed instructions and responds to user commands entered through a suitable device, such as a keyboard or a touch screen. The controller 50 is preferably adapted to activate alarms 56 when certain unsafe or undesirable operating conditions occur.

Figure 2:
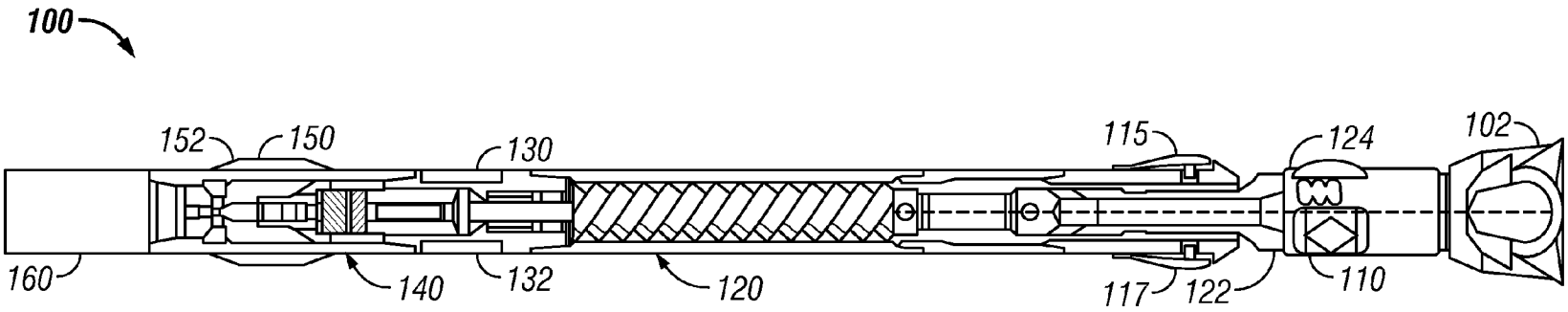
FIG. 2 illustrates an exemplary bottom hole assembly made in accordance with one embodiment of the present disclosure.

Referring now to FIG. 2, there is shown in greater detail an exemplary bottom hole assembly (BHA) 100 made in accordance with the present disclosure. As will be described below, the BHA 100 may automatically drill a wellbore having one or more selected bore diameters. By "automatically," it is meant that the BHA 100 using downhole and/or surface intelligence and based on received sensor data input may control drilling direction using pre-programmed instructions. Drilling direction may be controlled utilizing a selected wellbore trajectory, one or more parameters relating to the formation, and/or one or more parameters relating to operation of the BHA 100. One suitable drilling assembly named VERTI-TRAK® is available from Baker Hughes Incorporated. Some suitable exemplary drilling systems and steering devices are discussed in U.S. Pat. Nos. 6,513,606 and 6,427,783, which are commonly assigned and which are hereby incorporated by reference for all purposes. It should be understood that the present disclosure is not limited to any particular drilling system.

In one embodiment, the BHA 100 includes a drill bit 102, a hole enlargement device 110, a steering device 115, a drilling motor 120, a sensor sub 130, a bidirectional communication and power module (BCPM) 140, a stabilizer 150, and a formation evaluation (FE) sub 160. In an illustrative embodiment, the hole enlargement device 110 is integrated into a motor flex shaft 122 using a suitable electrical and mechanical connection 124. The hole enlargement device 110 may be a separate module that is mated to the motor flex shaft 122 using an appropriate mechanical joint and data and/or power connectors. In another embodiment, the hole enlargement device 110 is structurally incorporated in the flex shaft 122 itself. The steering device 115 and the hole enlargement device 110 may share a common power supply, e.g., hydraulic or electric, and a common communication system.

To enable power and/or data transfer to the hole enlargement device 110 and among the other tools making up the BHA 100, the BHA 100 includes a power and/or data transmission line (not shown). The power and/or data transmission line (not shown) may extend along the entire length of the BHA 100 up to and including the hole enlargement device 110 and the drill bit 102. Exemplary uplinks, downlinks and data and/or power transmission arrangements are described in commonly owned and U.S. patent application Ser. No. 11/282,995, filed Nov. 18, 2005, now U.S. Pat. No. 7,708,086, issued May 4, 2010, which is hereby incorporated by reference for all purposes.

As seen in the detailed discussion below, embodiments of the present disclosure include BHAs adapted for automated "sliding drilling" and that can selectively enlarge the diameter of the wellbore being drilled. The hole enlargement device may include expandable cutting elements or blades. Surface personnel may use the power and/or data link between the hole enlargement device and BCPM and the surface to determine the position of the hole enlargement device blades (i.e., expanded or retracted) and to issue instructions to cause the blades to move between an expanded and retracted position. Thus, for example, the hole enlargement device blades can be shifted to an expanded position as the BHA penetrates a swelling formation such as shale and later returned to a retracted position as the BHA penetrates into a more stable formation. One suitable hole enlargement device is referred to as an "underreamer" in the art.

Figure 3:
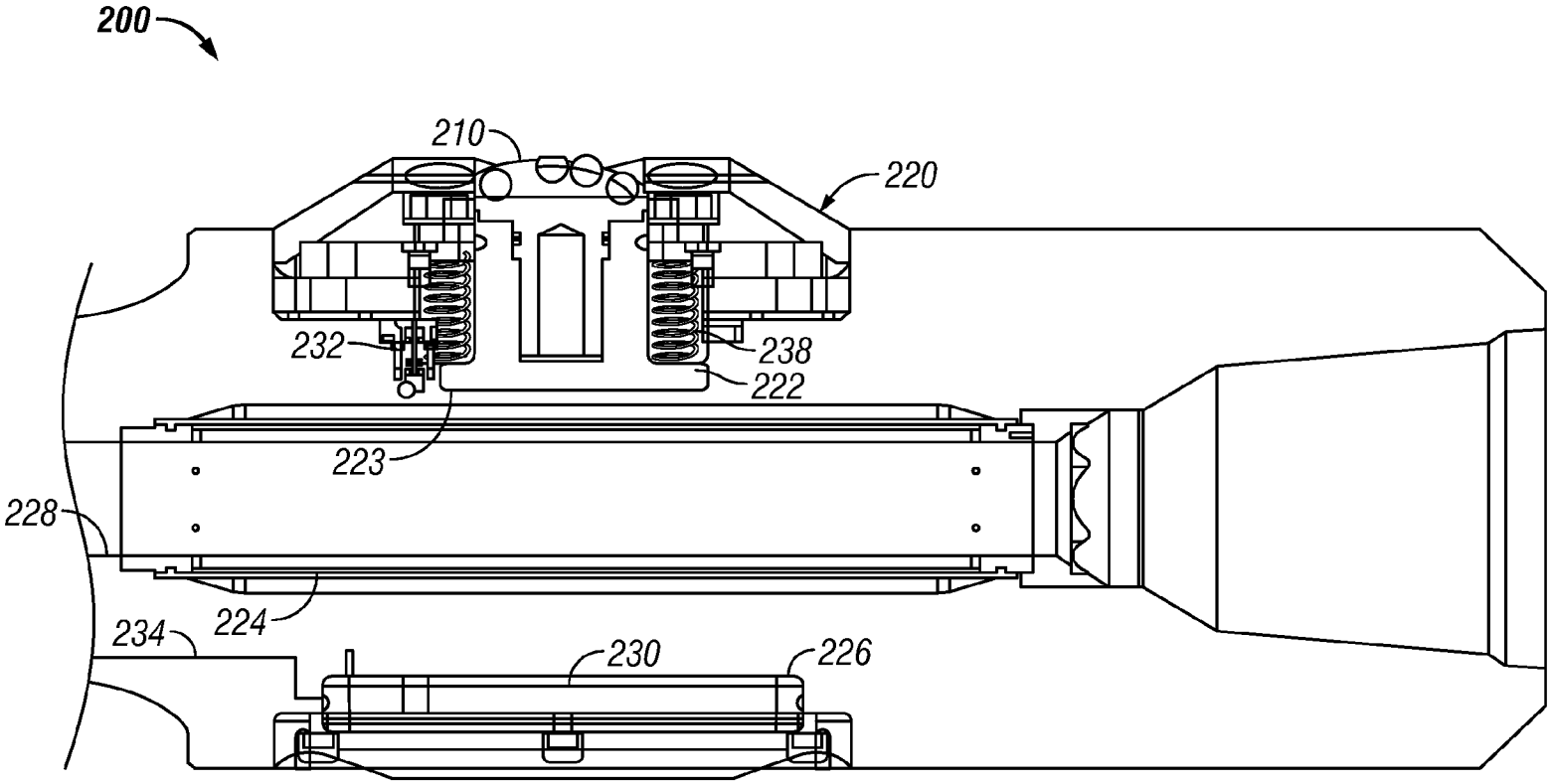
FIG. 3 illustrates an exemplary hole enlargement device made in accordance with one embodiment of the present disclosure.

Referring now to FIG. 3, there is shown one embodiment of a hole enlargement device 200 made in accordance with the present disclosure that can drill or expand the hole drilled by the drill bit 102 to a larger diameter. In one embodiment, the hole enlargement device 200 includes a plurality of circumferentially spaced-apart cutting elements 210 that may, in real-time, be extended and retracted by an actuation unit 220. When extended, the cutting elements 210 scrape, break up and disintegrate the wellbore surface formed initially by the drill bit 102. In one arrangement, the actuation unit 220 utilizes pressurized hydraulic fluid as the energizing medium. For example, the actuation unit 220 may include a piston 222 disposed in a cylinder 223, an oil reservoir 224, and valves 226 that regulate flow into and out of the cylinder 223. A cutting element 210 is fixed on each piston 222. The actuation unit 220 uses "clean" hydraulic fluid that flows within a closed loop. The hydraulic fluid may be pressurized using pumps and/or by the pressurized drilling fluid flowing through a bore 228. In one embodiment, a common power source (not shown), such as a pump and associated fluid conduits, supplies pressurized fluid for both the hole enlargement device 110 and the steering unit 115 (FIG. 2). Thus, in this regard, the hole enlargement device 110 and the steering unit 115 may be considered as hydraulically operatively connected. An electronics package 230 controls valve components such as actuators (not shown) in response to surface and/or downhole commands and transmits signals indicative of the condition and operation of the hole enlargement device 200. A position sensor 232 fixed adjacent to the cylinder 223 provides an indication as to the radial position of the cutting elements 210. For example, the sensor 232 may include electrical contacts that close when the cutting elements 210 are extended. The position sensor 232 and electronics package 230 communicate with the BCPM 140 (FIG. 2) via a line 234. Thus, for instance, surface personnel may transmit instructions from the surface that cause the electronics package 230 to operate the valve actuators for a particular action (e.g., extension or retraction of the cutting elements 210). A signal indicative of the position of the cutting elements 210 is transmitted from the position sensor 232 via the line 234 to the BCPM 140 and, ultimately, to the surface where it may, for example, be displayed on display 54 (FIG. 1). The cutting elements 210 may be extended or retracted in situ during drilling or while drilling is interrupted. Optionally, devices such as biasing elements such as springs 238 may be used to maintain the cutting elements 210 in a retracted position.

In other embodiments, the actuation unit 220 may use devices such as an electric motor or employ shape-changing materials such as magnetostrictive or piezoelectric materials to translate the cutting elements 210 between the extended and retracted positions. In still other embodiments, the actuation unit 220 may be an "open" system that utilizes the circulating drilling fluid to displace the piston 222 within the cylinder 223. Thus, it should be appreciated that embodiments of the hole enlargement device 200 may utilize mechanical, electromechanical, electrical, pneumatic and hydraulic systems to move the cutting elements 210.

Additionally, while the hole enlargement device 200 is shown as integral with the motor flex shaft 122, in other embodiments, the hole enlargement device 200 may be integral with the drill bit 102. For example, the hole enlargement device 200 may be adapted to connect to the drill bit 102. Alternatively, the drill bit 102 body may be modified to include radially expandable cutting elements (not shown). In still other embodiments, the hole enlargement device 200 may be positioned in a sub, positioned between the steering device 130 and the drill bit 102, or elsewhere along the drill string 22 (FIG. 1). Moreover, the hole enlargement device 200 may be rotated by a separate motor (e.g., mud motor, electric motor, pneumatic motor) or by drill string rotation. It should be appreciated that the above-described embodiments are merely illustrative and not exhaustive. For example, other embodiments within the scope of the present disclosure may include cutting elements in one section of the BHA and the actuating elements in another section of the BHA. Still other variations will be apparent to one skilled in the art given the present teachings.

As previously discussed, embodiments of the present disclosure are utilized during "automated" drilling. In some applications, the drilling is automated using downhole intelligence that control drilling direction in response to directional data (e.g., azimuth, inclination, north) measured by onboard sensors. The intelligence may be in the form of instructions programmed into a downhole controller that is operatively coupled to the steering device. Discussed in greater detail below are illustrative tools and components suitable for such applications.

Referring now to FIG. 2, the data used to control the BHA 100 is obtained by a variety of tools positioned along the BHA 100, such as the sensor sub 130 and the formation evaluation sub 160. The sensor sub 130 may include sensors for measuring near-bit direction (e.g., BHA azimuth and inclination, BHA coordinates, etc.), dual rotary azimuthal gamma ray, bore and annular pressure (flow-on and flow-off), temperature, vibration/dynamics, multiple propagation resistivity, and sensors and tools for making rotary directional surveys.

The formation evaluation sub 160 may include sensors for determining parameters of interest relating to the formation, borehole, geophysical characteristics, borehole fluids and boundary conditions. These sensors include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

The subs 130 and 160 may include one or memory modules and a battery pack module to store and provide backup electrical power that may be placed at any suitable location in the BHA 100. Additional modules and sensors may be provided depending upon the specific drilling requirements. Such exemplary sensors may include an rpm sensor, a weight-on-bit sensor, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry as generally known in the art. These sensors may be positioned in the subs 130 and 160, distributed along the drill pipe, in the drill bit 102 (FIG. 1) and along the BHA 100. Further, while subs 130 and 160 are described as separate modules, in certain embodiments, the sensors described above may be consolidated into a single sub or separated into three or more subs. The term "sub" refers merely to any supporting housing or structure and is not intended to mean a particular tool or configuration.

For automated drilling, a processor 132 processes the data collected by the sensor sub 130 and formation evaluation sub 160 and transmit appropriate control signals to the steering device 115. In response to the control signals, pads 117 of the steering device 115 extend to apply selected amounts of force to the wellbore wall (not shown). The applied forces create a force vector that urges the drill bit 102 in a selected drilling direction. The processor 132 may also be programmed to issue instructions to the hole enlargement device 110 and/or transmit data to the surface. The processor 132 may be configured to decimate data, digitize data, and include suitable PLCs. For example, the processor 132 may include one or more microprocessors that uses a computer program implemented on a suitable machine-readable medium that enables the processor 132 to perform the control and processing. The machine-readable medium may include ROMs, EPROMs, EAROMs, Flash memories and optical disks. Other equipment such as power and data buses, power supplies, and the like, will be apparent to one skilled in the art. While the processor 132 is shown in the sensor sub 130, the processor 132 may be positioned elsewhere in the BHA 100. Moreover, other electronics, such as electronics that drive or operate actuators for valves and other devices, may also be positioned along the BHA 100.

The bidirectional data communication and power module ("BCPM") 140 transmits control signals between the BHA 100 and the surface as well as supplies electrical power to the BHA 100. For example, the BCPM 140 provides electrical power to devices such as the hole enlargement device 110 and steering device 115 and establishes two-way data communication between the processor 132 and surface devices such as the controller 50 (FIG. 1). In this regard, hole enlargement device 110 and the steering device 115 may be considered electrically operatively connected. In one embodiment, the BCPM 140 generates power using a mud-driven alternator (not shown) and the data signals are generated by a mud pulser (not shown). The mud-driven power generation units (mud pursers) are known in the art and thus not described in greater detail. In addition to mud pulse telemetry, other suitable two-way communication links may use hard wires (e.g., electrical conductors, fiber optics), acoustic signals, EM or RF. Of course, if the drill string 22 (FIG. 1) includes data and/or power conductors (not shown), then power to the BHA 100 may be transmitted from the surface.

The BHA 100 also includes the stabilizer 150, which has one or more stabilizing elements 152, and is disposed along the BHA 100 to provide lateral stability to the BHA 100. The stabilizing elements 152 may be fixed or adjustable.

Referring now to FIGS. 1-3, in an exemplary manner of use, the BHA 100 is conveyed into the wellbore 12 from the rig 14. During drilling of the wellbore 12, the steering device 115 steers the drill bit 102 in a selected direction. In one mode of drilling, only a mud motor 104 rotates the drill bit 102 (sliding drilling) and the drill string 22 remains relatively rotationally stationary as the drill bit 102 disintegrates the formation to form the wellbore. The drilling direction may follow a preset trajectory that is programmed into a surface and/or downhole controller (e.g., controller 50 and/or controller 132). The controller(s) use directional data received from downhole directional sensors to determine the orientation of the BHA 100, compute course correction instructions if needed, and transmit those instructions to the steering device 115. During drilling, the radial position (e.g., extended or retracted) of the cutting elements 210 is displayed on the display 54.

At some point, surface personnel may desire to enlarge the diameter of the well being drilled. Such an action may be due to encountering a formation susceptible to swelling, due to a need for providing a suitable annular space for cement or for some other drilling consideration. Surface personnel may transmit a signal using the communication downlink (e.g., mud pulse telemetry) that causes the downhole electronics 230 to energize the actuation unit 220, which in turn extends the cutting elements 210 radially outward. When the cutting elements 210 reach their extended position, the position sensor 232 transmits a signal indicative of the extended position, which is displayed on display 54. Thus, surface personnel are affirmatively notified that the hole enlargement device 110 is extended and operational. With the hole enlargement device 110 activated, automated drilling may resume (assuming drilling was interrupted—which is not necessary). The drill bit 102, which now acts as a type of pilot bit, drills the wellbore to a first diameter while the extended cutting elements 210 enlarge the wellbore to a second, larger diameter. The BHA 100 under control of the processors 50 and/or 132 continues to automatically drill the formation by adjusting or controlling the steering device 115 as needed to maintain a desired wellbore path or trajectory. If at a later point personnel decide that an enlarged wellbore is not necessary, a signal transmitted from the surface to the downhole electronics 230 causes the cutting elements 210 to retract. The position sensor 232, upon sensing the retraction, generates a corresponding signal, which is ultimately displayed on display 54.

It should be understood that the above drilling operation is merely illustrative. For example, in other operations, the surface and/or downhole processors may be programmed to automatically extend and retract the cutting elements as needed. As may be appreciated, the teachings of the present application may readily be applied to other drilling systems. Such other drillings systems include BHAs coupled to a rotating drilling string and BHAs, wherein rotation of the drill string is superimposed on the mud motor rotation.

The foregoing description is directed to particular embodiments of the present disclosure for the purpose of illustration and explanation. It will be apparent, however, to one skilled in the art that many modifications and changes to the embodiments set forth above are possible without departing from the scope of the disclosure. It is intended that the following claims be interpreted to embrace all such modifications and changes.

We claim:

1. An apparatus for forming a wellbore in an earthen formation, comprising:

a drill bit;

a downhole drilling motor comprising a housing and an output shaft;

a controllable steering device comprising a housing connected to the drilling motor housing, the controllable steering device including at least one pad extensible relative to the steering device housing to steer the drill bit in a selected direction by application of lateral force to a wall of the wellbore; and a hole enlargement device having selectively extendable cutting elements configured to automatically extend and retract to selectively enlarge the diameter of the wellbore formed by the drill bit;

wherein the output shaft extends through the steering device housing, the hole enlargement device is operably coupled to the output shaft on a side of the steering device opposite the drilling motor, and the drill bit is operably coupled, with no intermediate components therebetween, to the hole enlargement device on a side thereof opposite the steering device.

2. The apparatus according to claim 1, further comprising a processor operatively connected to the controllable steering device, the processor being programmed with instructions for controlling the steering device in response to a measured parameter of interest selected from one of (i) drilling direction parameter, (ii) a formation parameter and (iii) an operating parameter.

3. The apparatus according to claim 1, further comprising a communication link between the hole enlargement device and a surface location and between the steering device and the surface location.

4. The apparatus according to claim 3, wherein the communication link is selected from one of: (i) a data signal transmitted via a conductor, (ii) an optical signal transmitted via a conductor, (iii) an electromagnetic signal, (iv) a pressure pulse, and (v) an acoustic signal.

5. The apparatus according to claim 1, further comprising a conductor operatively coupled to the hole enlargement device and to the steering device, the conductor providing data communication between the hole enlargement device and a surface location and between the steering device and the surface location.

6. The apparatus according to claim 5, wherein the conductor is selected from one of: (i) at least one conductive element formed along a drilling tubular, and (ii) at least one conductive element positioned adjacent a coiled tubing.

7. The apparatus according to claim 1, wherein the hole enlargement device and the steering device are configured to hydraulically actuate.

8. The apparatus according to claim 7, wherein the hole enlargement device and the steering device have a hydraulic connection.

9. The apparatus according to claim 1, further comprising:

a sensor sub configured to detect operating parameters relating to whether the drill bit is penetrating a swelling formation; and a processor connected to the sensor sub, the processor being programmed to determine whether the drill bit is penetrating a swelling formation using operating parameters received from the sensor sub, the processor being programmed to send an actuation signal configured to cause the selectively extendable cutting elements of the hole enlargement device to automatically extend when the drill bit is penetrating a swelling formation and to send a deactivation signal configured to cause the selectively extendable cutting elements of the hole enlargement device to automatically retract when the drill bit is not penetrating a swelling formation.

10. The apparatus of claim 1, wherein the output shaft of the drilling motor comprises a flex shaft.

11. The apparatus of claim 1, wherein the controllable steering device and the hole enlargement device are operably coupled to a common power supply.

12. The apparatus of claim 1, wherein the controllable steering device and the hole enlargement device are operably coupled to a common communication link.

13. The apparatus of claim 1, further comprising a sensor sub comprising at least one sensor configured to measure at least one of azimuth, inclination, position coordinates, bore pressure, annulus pressure, temperature, and vibration.

14. The apparatus of claim 1, further comprising a formation evaluation sub comprising at least one sensor configured to determine at least one of formation characteristics, borehole parameters, geophysical parameters, borehole fluid parameters, and boundary conditions.

15. A system for forming a wellbore in an earthen formation, comprising:

a drill string having a drill bit at an end thereof;

a controllable steering device configured to automatically steer the drill bit in a selected direction, wherein the controllable steering device includes a housing and at least one pad configured to apply a force to a wall of the wellbore, the controllable steering device being configured to automatically extend and retract the at least one pad; and a downhole drilling motor comprising:

a housing;

an output shaft configured to rotate the drill bit, the drill bit being configured to connect to the output shaft; and a hole enlargement device having selectively extendable cutting elements configured to extend and retract to selectively enlarge the diameter of the wellbore formed by the drill bit, wherein the output shaft extends through the housing of the controllable steering device, the selectively extendable cutting elements of the hole enlargement device are connected to the output shaft on a side of the controllable steering device opposite the drilling motor, and the drill bit is operably coupled, with no intermediate components therebetween, to the hole enlargement device on a side thereof opposite the controllable steering device.

16. The system of claim 15, wherein the controllable steering device and the hole enlargement device are operably coupled to a common power supply.

17. The system of claim 15, wherein the controllable steering device and the hole enlargement device are operably coupled to a common communication link.

18. The system of claim 15, further comprising a sensor sub connected to the drill string, the sensor sub comprising at least one sensor configured to measure at least one of azimuth, inclination, position coordinates, bore pressure, annulus pressure, temperature, and vibration.

19. The system of claim 15, further comprising a formation evaluation sub connected to the drill string, the formation evaluation sub comprising at least one sensor configured to determine at least one of formation characteristics, borehole parameters, geophysical parameters, borehole fluid parameters, and boundary conditions.

20. The system according to claim 15, further comprising a processor operatively connected to the controllable steering device, the processor being programmed with instructions for controlling the steering device in response to a measured parameter of interest selected from one of (i) drilling direction parameter, (ii) a formation parameter and (iii) an operating parameter.

21. The system according to claim 15, further comprising a communication link between the hole enlargement device and a surface location and between the controllable steering device and the surface location.

* * * * *

UNITED STATES PATENT AND TRADEMARK OFFICE

CERTIFICATE OF CORRECTION

PATENT NO. : 9,187,959 B2
APPLICATION NO. : 11/681370
DATED : November 17, 2015
INVENTOR(S) : Joachim Treviranus et al.

It is certified that error appears in the above-identified patent and that said Letters Patent is hereby corrected as shown below:

On the title page:

In ITEM (75) INVENTORS: change "Carsten Freyer, Lower Saxony (DE); Hans-Robert Oppelaar, Lower Sachony (DE)" to --Carsten Freyer, Wienhausen (DE); Hans-Robert Oppelaar, Bergen (DE);--

Signed and Sealed this
Twenty-ninth Day of March, 2016

Michelle K. Lee

Michelle K. Lee
*Director of the United States Patent and Trademark Office*